United States Patent [19]

Pitkin, Jr. et al.

[11] 3,930,604

[45] Jan. 6, 1976

[54] WALKING STICK AND STAPLE FASTENING TOOL

[76] Inventors: Roy S. Pitkin, Jr., 2735 NE. 18th Ave., Portland, Oreg. 97212; Timothy A. Pitkin, 53 SE. 74th Ave., Portland, Oreg. 97215

[22] Filed: June 3, 1974

[21] Appl. No.: 475,666

[52] U.S. Cl. ..... 227/8; 227/110; 227/130

[51] Int. Cl.[2] ..... B25C 5/10

[58] Field of Search ..... 227/5, 6, 7, 8, 110, 111, 227/130

[56] References Cited

UNITED STATES PATENTS

| | | | |
|---|---|---|---|
| 2,915,754 | 12/1959 | Wandel | 227/5 |
| 3,272,267 | 9/1966 | Langes | 227/130 |
| 3,595,460 | 7/1971 | Pitkin | 227/130 |
| 3,734,377 | 5/1973 | Munn | 227/120 |
| 3,771,708 | 11/1973 | Nicola et al. | 227/111 |
| 3,796,365 | 3/1974 | Downing | 227/8 |

*Primary Examiner*—Granville Y. Custer, Jr.
*Attorney, Agent, or Firm*—Rummler & Snow

[57] ABSTRACT

A fastening tool on the end of a stick operated from a comfortable erect and standing position with but one hand of the operator capable of being easily converted to a hand tool wherein the foot arming function becomes one for the hand, having a trip device which fires the stapler upon contact with the deck when the stick is lowered slightly by a flip of the wrist for arming the same, and capable of rolling thereon without lifting therefrom.

3 Claims, 6 Drawing Figures

WALKING STICK AND STAPLE FASTENING TOOL

BACKGROUND OF THE INVENTION

Hand-operated roofing tools for fastening the base sheet require that the roofer be doubled over rather than standing erect most of the time and incur additional weight for the operator to pick up and set down in rapid order resulting in fatigue, sore muscles and stiff backs and frequent interruptions in work in order to rest.

In order to fill the need of a tool which will fasten base sheet without the necessity of a roofer being physically discomfitured most of the time and with conformance to his natural body movements so that fatigue on the job is minimized, the weight of the nailer must be kept on the roof and it must be moved around on wheels. Remote control of the triggering of the tool is essential so that the operator need not bend over to fire the fool. As the operator walks along, he should be able to activate the trip in a steady rhythm inserting fasteners into the deck at the desired spacing simply by controlling the speed of his walk.

In addition, the tool should be capable of instant conversion from a "stand-up" operated tool to a hand-operated tool so the operator can work around roof appurtenances, steep roof areas or vertical surfaces, such as parapet walls, crickets, etc.

SUMMARY OF THE INVENTION

The gist of this invention lies in the application of a walking stick to a modified standard Bostitch T-34-6 fastening tool which is modified to be rolled on the roof deck and operated from an erect stand-up position by the easy flick of the wrist of but one hand of the operator. The Bostitch tool has its normal trigger device converted to an "on-off" arming mechanism for arming and disarming the tool, and its normal safety contact trip device and its lever arm on the head-end thereof converted to a tool actuating mechanism. "Actuating" of the tool drives a staple into the roof deck. "Arming" or "disarming" of the tacker overrides the actuating mechanism as an "on-off" control permitting or preventing the actuating mechanism from operating. The tool can be actuated only after the operator arms it. Arming can be accomplished with the foot while standing erect in the manner of this invention or with the finger by hand-operation while bending over in the manner of the usage of the standard tool.

The arming mechanism for the walking stick fastening tool comprises a torque-rod pivotally mounted in the fore-and-aft direction on the top side of the head-end of the Bostitch tool having a lever attached to one end which extends at right angles from the torque-rod in a downwardly direction therefrom over and aft of the head-end of the body of the tool. A torque-arm mounts to the fore-end of the torque-rod above the body of the tool and in transverse relation thereto and encircles the body thereof at a working clearance therefrom and extends downward and under and across into a position below in transverse relation to and in operational contact with the normal trigger of the Bostitch tool on the lower surface thereof for transmitting arming motion to the trigger and to the tool by pressing it against the body thereof.

The walking stick attaches at one end to the head-end of the Bostitch tool and extends aftwardly therefrom in a diagonally upwardly direction. The operator places himself adjacent to and grasps the upper grip end of the stick preparatory to lowering and raising the same as he walks along the roof pushing the tool on its wheels. Each time the stick is lowered, a staple is driven.

After the tool has been armed and placed on the roof deck in preparation for stapling, the head-end of the tool is lowered by pivoting the body of the tool around the wheels at its heel-end as a fulcrum. This is done by lowering the grip end of the walking stick. Lowering the head-end of the tool contacts the actuating mechanism with the deck and actuates the tool to drive a staple in the deck.

The actuating mechanism comprises a yoke which is mounted on the modified Bostitch contact trip lever arm. This arm loosely supports an axle on the ends of which roller wheels are rotatably mounted. These rollers sense contact with the deck.

DESCRIPTION OF THE PREFERRED EMBODIMENT

Figures 1, 2, 3, 4, 5, 6:
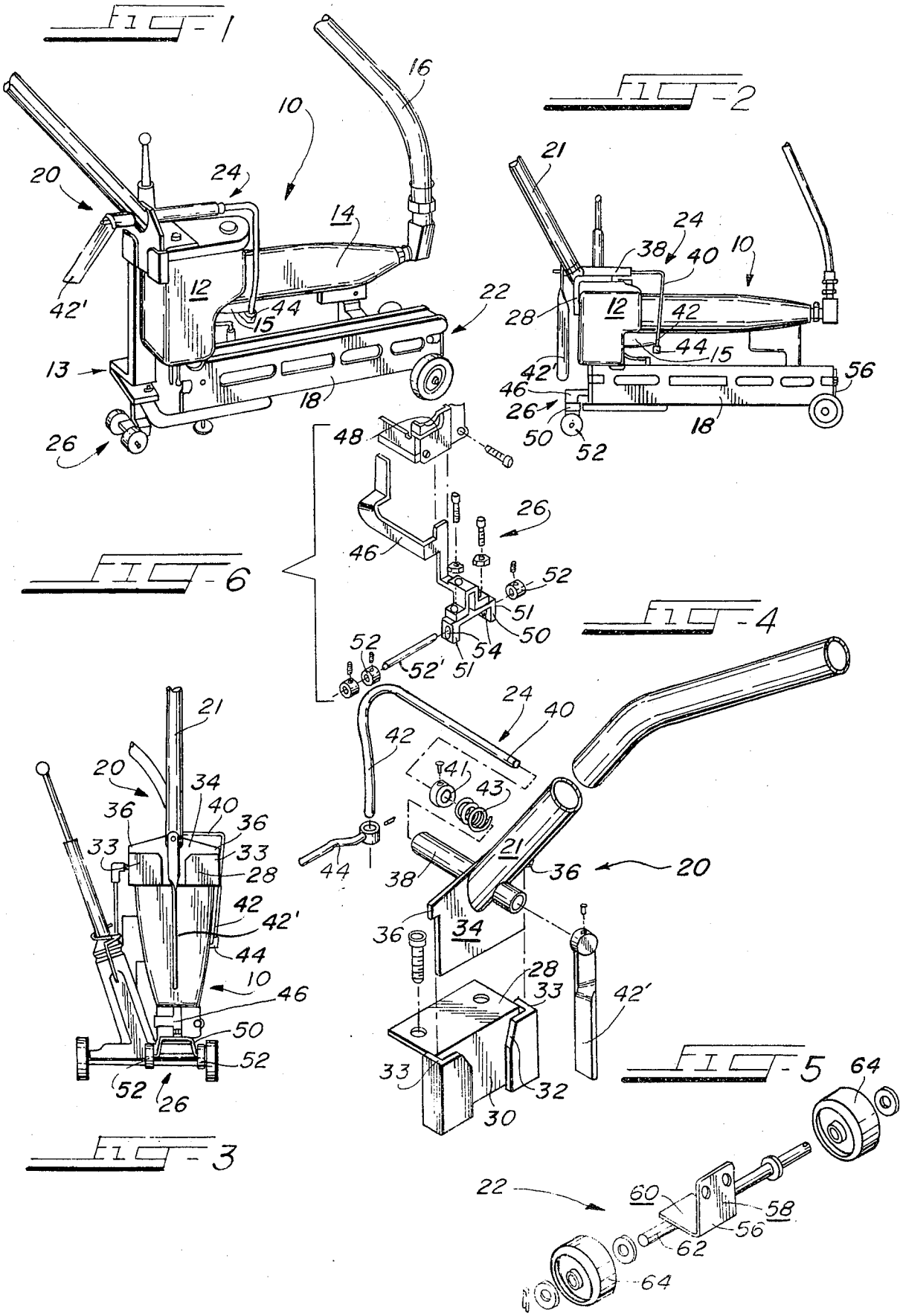
FIG. 1 is a perspective view of the device of my invention.
FIG. 2 is a side elevation view of the same.
FIG. 3 is a head and elevation view of the same.
FIG. 4 is a fragmented exploded view of the parts of the walking stick assembly.
FIG. 5 is an exploded view of the heel and wheel assembly.
FIG. 6 is an exploded view of the modified contact trip assembly and guide.

Referring to FIG. 1, a Bostitch T-34-6 tacker tool assembly 10 comprises a head end 12 having a Standard Bostitch T-34-6 disc feed and staple driving head 13 mounted thereon. A handle 14 having a trigger 15 mounted on the under side thereof is connected to and extends from one side of the head end 12. An air supply line 16 is in fluid communication with an air inlet port on the handle 14 of the tool 10. A staple magazine 18 is connected to the head end 12 and extends therefrom and spaced below the handle 14 thereof. A walking stick assembly 20 fastens to the top and on the end face of the head end 12 on a vertical center line of the tool 10. A trigger actuating assembly 24 comprises a torque rod 40 which pivotally mounts in a sleeve 38 which is fastened to plate 34 adjacent the lower end of the walking stick assembly 20 and extends through the lower end of the handle 14 transverse relation thereto and in contact with the lower side of the trigger 15. A contact trip assembly 26 comprises a contact trip lever arm 46 which slidably mounts a trip guide 48 which is secured to the lower side of head end 12 of tool 10 adjacent the standard Bostitch T-34- 6 staple driving mechanism 13. A heel end pivot assembly 22 mounts to the heel end of the magazine 18 of the tool 10.

Referring to FIGS. 2 and 3, the walking stick assembly 20 comprises a stick 21 which extends upwardly and outwardly in a vertical plane from the head end 12 of the tool 10 at an approximate angle of 60° to the horizontal. An inverted L-shaped head bracket 28 has a horizontal flange portion thereof which is bolted on the head end 12. The other portion of the bracket 28 extends in a vertical plane and hangs over the end face of head end 12. As shown in FIG. 4, a "T" slot 30 is formed on the vertical flange of the head bracket 28 facing in an outwardly direction therefrom. Beveled edges 32 form shoulders 33 at the top of the "T" slot 30 thereon.

A "T" plate 34 having ears 36 on the side edges thereof is mounted in a vertical plane at the lower end of the stick 21 in transverse relation thereto, as shown in FIGS. 3 and 4. "T" plate 34 which is mounted on the lower end of stick 21 inserts in "T" slot 30 on bracket 28 in the installation thereon to the extent that ears 36 rest on shoulders 33 in the assembly thereof. The opposite free end of the stick 21 is provided with the usual handle.

Referring to FIGS. 2 and 4, the trigger actuating assembly 24 comprises a pivot sleeve 38 mounted to the lower end of the walking stick assembly 20 and having its axis extending horizontally and contained in a vertical plane formed by the juncture of the centerlines of the stick 21 and the gun 10. A torque rod 40 pivotally mounts in the sleeve 38 and has one end extending out therefrom in the direction of the horizontal extension of the stick 21. A lever 42′ is fixedly mounted on said outstanding end of rod 40 under the stick 21 and is suitable for pivotal actuation by the toe of the operator. A collar and set screw combination 41 and compression spring 43 are mounted on the other outstanding end of rod 40 for securing said rod in the sleeve 38. A torque arm 42 of horizontal torque rod 40 extends sidewise from above a centerline position of the tool 10 in a direction around the body of the tool handle 14 and below the trigger 15. At this level, a trigger actuating arm 44 is connected to the lower end of the torque arm 42 of the rod 40 which extends in a direction under and is in contact with the loewr side of the trigger 15.

Referring to FIGS. 2, 3 and 6, the contact trip assembly 26 comprises a contact trip lever arm 46 which is modified from that on the Bostitch T-34-6 tacker and installed on the head end 12 of the tool 10. A modified trip guide 48 mounted on the head end 12 guides the modified contact trip lever arm 46 thereon. A yoke 50 is secured to the lower end of the trip lever arm 46. Arms 51 of yoke 50 extend to a lower level adjacent to the nail head 13. Vertical slots 54, as shown in FIG. 6, are cut in the arms 51 of the yoke 50. A yoke axle 52′ is received in the slots 54 in the arms 51 of the yoke 50 and is held in transverse relation therein relative to the longitudinal axis of the tool 10. Collars 52 fixedly mount on each outstanding end of the yoke axle 52′ spaced equidistant on each side of the longitudinal axis of the tool 10.

Referring to FIGS. 2 and 5, the heel end pivot assembly 22 comprises an axle support bracket 56 having a heel plate 58 which is fastened in a vertical plane to the heel end of the magazine 18 and a shoe plate 60 extending in a horizontal plane. A wheel axle 62 is secured to the under side of the shoe plate 60 in transverse relation to the longitudinal axis of the tool 10, and wheels 64 are rotatably mounted on each outstanding end thereof spaced equidistant on each side of said longitudinal axis.

It should be obvious that the lever 42′ may have an extension arm attached thereto so the upper end thereof can also be used to move lever 42′ for operation of the tool by hand instead of only being toe actuated.

In the setting up of the modified standard Bostitch T-34-6 stitcher tool 10 as a roof disc stapler which is operable with the flick of the wrist of but one hand from a standing position, the walking stick 21 is attached to the head-end 12 of the tool 10 by inserting T-plate 34 into slot 30 on the bracket 28 so that the stick 21 angles rearwardly and upwardly from the head end 12 of the tool 10. The torque rod 40 with collar 41 and compression spring 43 slipped over the outstanding end thereof is installed through the sleeve 38 on the walking stick 21 in a rearward direction relative thereto, and the hub of lever 42′ is secured on the end thereof so that the spring 43 compression loads the face of the hub of lever 42′ against the end of the sleeve 38.

In order to operate the tool 10 from a standing position, the tool 10 is armed by rotating lever 42′ in a clockwise direction when viewed from the head end of the tool 10 with a kick of the operator's foot. Trigger arm 44 shifts the usual trigger 15 upwardly and holds trigger 15 in place. Trigger-actuating arm 44, which is an extension of torque rod 40 and the hub of lever 42′, has a cam surface along its upper side, as shown in FIG. 4, which operationially slides under trigger 15 as lever 42′ is rotated and locks the same in an upward direction. This arms tool 10 in readiness for stapling.

In the stapling operation, the walking stick 21 is raised by an up-flick of the wrist by pivoting the heel end 22. Thus the tool is disarmed but when the upward pressure on the handle is released, the contact trip 26 of the tool 10 firmly contacts the deck. Tool 10 staples once each time the contact trip 26 touches the deck so that if the operator starts walking with the walking stick 21 in hand, flicking the wrist easily up as he goes, fasteners will be driven into the deck at a spacing which can be controlled simply by gauging walking speed with the frequency that the wrist is flicked.

In order to disarm the tool 10, lever 42′ is rotated in a counterclockwise direction when viewed from the head end of tool 10 so trigger arm 44 unlocks trigger 15. When disarmed, tool 10 will not staple if the contact trip 26 by chance contacts the deck.

Although but one specific embodiment of this invention is herein shown and described, it will be understood that details of the construction shown may be altered or omitted without departing from the spirit of the invention as defined by the following claims.

We claim:

1. In a stapler tool for use on roofing decks of the class described, a frame, a tool handle on said frame, a staple driver head mounted on said frame, a handle connected to said head adjacent to the top thereof and extending in a direction opposed to the staple driver, a staple magazine connected to said head adjacent the base thereof, a trigger pivotally connected to the under side of the handle adjacent to the head thereof, and a deck contact trip assembly mounted on said head said trigger and said deck contact trip assembly being simultaneously actuatable to operaate said staple driver head, said deck contact trip assembly comprising a trip lever and a trip guide, a contact trip lever arm slidingly engaging said trip guide for movement in the vertical direction thereon and extending downwardly and outwardly from engagement therewith, deck contacting means mounted on said contact trip lever arm extending downward therefrom substantially in line with the staple driver; a heel end pivot means mounted on the magazine on the end thereof opposed to the head of the frame, a walking stick means removably mounted on the upper portion of the head of the frame extending upwardly and outwardly therefrom, and an operator actuated trigger actuating means mounted on the walking stick assembly adjacent to the top of the head, whereby the operator may actuate the trigger and by shifting the terminal free end of the walking stick trip the contact trip assembly to drive a staple.

2. A stapler tool as set forth in claim 1 wherein the trigger actuating means comprises:

a. a sleeve adjacently secured to the lower end of said handle having a center line extending in a horizontal direction and having a first open end above the trigger and a second open end overhanging the head of the tool in the direction of the walking stick means;

b. a torque rod pivotally mounted in the sleeve and extending out from each open end thereof;

c. an arming lever fixedly mounted on the end of the torque rod extending out the second end of the sleeve generally extending in a direction at right angles relative thereto, and having a working clearance relative to the head of the tool;

d. a torque arm fixedly mounted at one end to the first end of the torque rod and generally extending in a direction at right angles relative thereto, and e. a trigger actuating arm integrally formed at one end to the second end of the torque arm and generally extending in a direction under the handle of the tool and operationally contacting the trigger thereat from below.

3. A stapler tool comprising a head end and staple driving head mounted thereon, a handle having a trigger mounted on the under side thereof connected to and extending from one side of the head end, a walking stick connected to and extending upwardly and outwardly from the other side of the head end, a staple magazine connected to the head end of the tool and extending therefrom and spaced below and in parallel relation to the tool handle, a trigger actuating assembly actuatable through said walking stick adjacent to and extending below the tool handle thereof in transverse relation thereto and in contact from below with the lower side of the trigger, a heel end wheq_assembly mounting to the heel end of the magazine a bracket secured to said head having one flange portion extending in a horizontal plane and another flange portion extending down in a vertical plane over the head end of the tool, said vertical flange having a pair of spaced side flanges forming a "T" slot a "T" plate having ears on the side edges thereof slidably mounted in the "T" slot and fixedly connected to one end of the walking stick at the head end of the tool, a pivot sleeve mounted to the lower end of the walking stick and "T" plate and having its axis extending horizontally, a torque rod pivotally mounting in the sleeve with both ends extending outwardly therefrom, a lever fixedly mounted on one end of the torque rod and terminating under the stick, the other end of said torque arm having a portion depending vertically at one side of said handle and terminating in a right angled cam arm extending below and in contact with the trigger of the tool, a trip guide mounted on the head end of of the tool, a contact trip lever arm slidingly installed in the trip guide for vertical guidance relative thereto, a yoke mounting to the lower end of the trip lever arm, arms extending from said yoke to a lower level adjacent to the driving head and having slots therein, a yoke axle loosely mounting in the slots and held in transverse relation therein relatiive to the handle of the tool, collars fixedly mounting on each outstanding end of the yoke axle outside of the yoke arms, an axle support bracket having a heel plate fastened in vertical relation to the heel end of the magazine of the tool and a shoe plate extending in a horizontal plane relative thereto, a wheel axle mounting to the under side of the shoe plate in transverse relation to the magazine, and wheels rotatably mounting on each end of said axle.

* * * * *